US006003476A

United States Patent [19]

Semedard et al.

[11] Patent Number: 6,003,476

[45] Date of Patent: Dec. 21, 1999

[54] BOILER HAVING AN EXTERNAL DENSE FLUIDIZED BED

[75] Inventors: Jean-Claude Semedard, Paris; Pierre Gauville, Verrieres Le Buisson; Christian Enault, Fontenay Aux Roses, all of France

[73] Assignee: Gec Alsthom Stein Industrie, Velizy-Villacoublay, France

[21] Appl. No.: 09/134,864

[22] Filed: Aug. 17, 1998

[30] Foreign Application Priority Data

Aug. 18, 1997 [FR] France ..... 9710425

[51] Int. Cl.[6] ..... F22B 1/00

[52] U.S. Cl. ..... 122/4 D; 110/245

[58] Field of Search ..... 122/4 D; 110/245

[56] References Cited

U.S. PATENT DOCUMENTS 3,968,346 7/1976 Cooksley ..... 122/31.1
4,473,032 9/1984 Maintok ..... 122/4 D
5,273,000 12/1993 Regan .
5,463,968 11/1995 Abdulally ..... 122/4 D

FOREIGN PATENT DOCUMENTS 0 068 301 A1 1/1983 European Pat. Off. .
0 274 637 A1 7/1988 European Pat. Off. .

*Primary Examiner*—John A. Jeffery
*Assistant Examiner*—Jiping Lu
*Attorney, Agent, or Firm*—Sughrue, Mion, Zinn, Macpeak & Seas, PLLC

[57] ABSTRACT

A boiler comprising a circulating fluidized bed hearth, a separator member for separating flue gas and solids extracted from the hearth, an external dense fluidized bed between the solids outlet of the separator member and the base of the hearth, the external bed containing a first heat exchanger in which a coolant fluid to be evaporated circulates. The outlet of the first heat exchanger is connected to a second heat exchanger placed in the hearth.

8 Claims, 3 Drawing Sheets

BOILER HAVING AN EXTERNAL DENSE FLUIDIZED BED

The present invention relates to a boiler including an evaporator immersed in an external dense fluidized bed.

BACKGROUND OF THE INVENTION

Such a boiler comprises, inter alia, the following elements:

- a circulating fluidized bed hearth whose walls comprise vertical pipes in which an emulsion (liquid phase and vapor phase) of water circulates, which emulsion is produced by evaporation of water fed into the bases of said pipes;
- a separator member (in general a cyclone) which, at the top of the hearth, recovers the flue gas and the solid particles fluidized in the hearth and directs said flue gas and said particles to respective ones of two distinct ducts; and
- an external fluidized bed connected firstly to the particles duct of the separator member and secondly to the base of the hearth, the external bed including a heat exchanger which transmits the heat from the particles to the coolant fluid to be evaporated, which fluid is often water.

Such a heat exchanger is commonly in the form of a nest of tubes and the fluid can circulate either naturally or with assistance from one or more pumps.

Natural-circulation heat exchangers are difficult to implement. Firstly, in order to operate at reasonable circulation rates, the tubes must be disposed so that they slope, which makes the heat exchanger taller than a heat exchanger in which the tubes are horizontal, if substantially the same heat exchange area is to be retained. Unfortunately, the height of the fluidized bed is limited by the fluidization pressure, and also by the fluidization stability. It can be assumed that said height cannot significantly exceed 4 meters, and, in any case, it would seem impossible to provide a height greater than 5 meters. Secondly, the speed in the tubes must be suitable for avoiding "departure from nucleate boiling" (DNB), and also for avoiding stratified flow, i.e. the appearance of a liquid-vapor interface. A flow of that type gives rise to overheating of the tubes, to thermal shocks, and to corrosion. To achieve the required speed, the tubes must be of large section and have large clearance heights at their top ends. In addition, during start-up, there is not a large enough quantity of hot particles present, so that, since vaporization is low, the speed in the tubes is too low and there is a risk of DNB.

Assisted-circulation heat exchangers make it possible to overcome the difficulties encountered with natural-circulation heat exchangers. Unfortunately, assistance pumps are costly, and there is a risk that they might break down, which is detrimental to boiler availability.

OBJECT AND BRIEF SUMMARY OF THE INVENTION

An object of the present invention is to provide a boiler which has an external dense fluidized bed, which is of simple design, and which is very reliable.

According to the invention, this boiler comprises a circulating fluidized bed hearth, a separator member for separating flue gas and solids extracted from the hearth, an external dense fluidized bed between the solids outlet of said separator member and the base of said hearth, the external bed containing a first heat exchanger in which a coolant fluid to be evaporated circulates, and, in addition, the outlet of the first heat exchanger is connected to a second heat exchanger placed in the hearth.

The second heat exchanger makes it possible to increase significantly the speed of circulation in the tubes of the first heat exchanger. Thus, even if the first heat exchanger operates by natural circulation, the tubes which make it up can be disposed horizontally without there being any risk for the installation.

Advantageously, the first heat exchanger is made up of a nest of tubes.

Preferably, the tubes are horizontal.

In addition, each of the tubes is provided with at least one helical groove.

Thus, it is possible to reduce the circulation speed to prevent DNB in the tubes.

In a first embodiment of the boiler, the second heat exchanger is an integral part of a wall of the hearth.

In a second embodiment, the second heat exchanger is immersed in the hearth.

The invention is particularly advantageous when the hearth is a circulating fluidized bed provided with internal webs welded to the wall-forming tubes of the hearth, such webs being referred to as "screen extensions".

Thus, in a third embodiment, the second heat exchanger is disposed in a screen extension of the hearth.

BRIEF DESCRIPTION OF THE DRAWINGS

The invention appears in more detail from the following description of examples of boilers given by way of illustration and with reference to the accompanying drawings, in which.

Like elements shown in various figures are given like references.

MORE DETAILED DESCRIPTION

Figure 1:
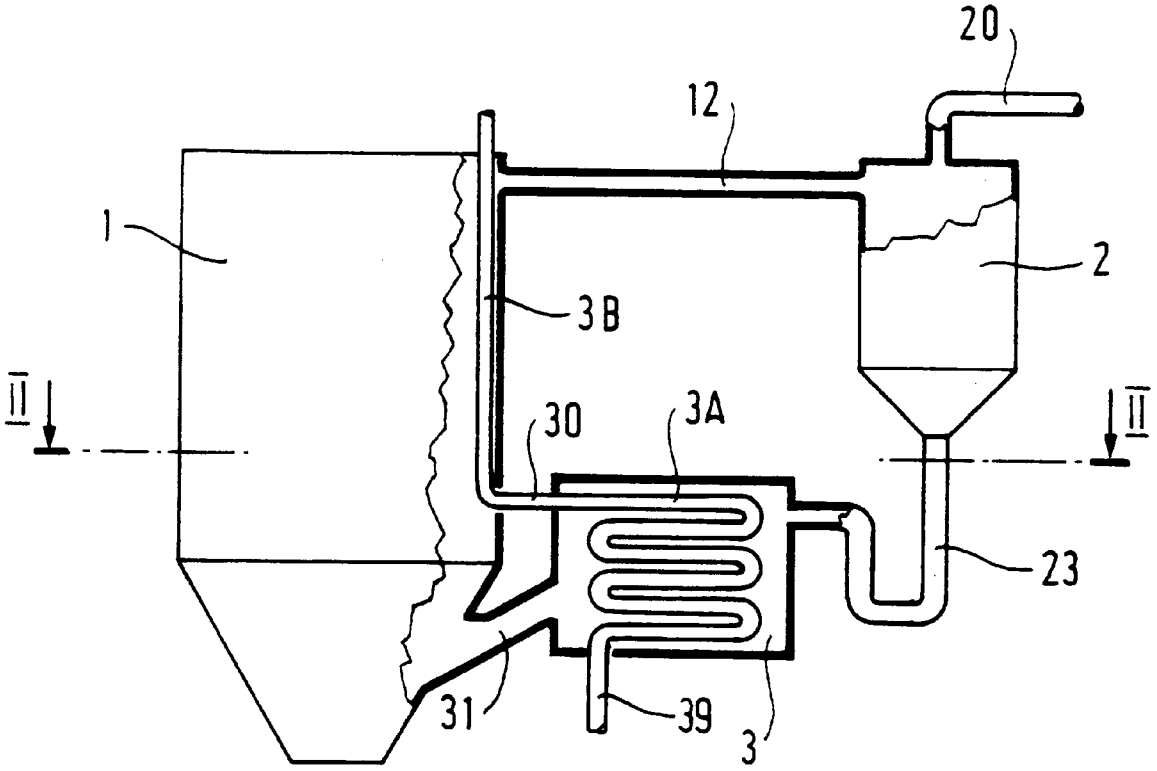
FIG. 1 is a diagram of a boiler of the invention.

FIG. 1 shows only those elements of the boiler which are necessary for understanding the invention.

The boiler includes a hearth 1 in which combustion of solid particles is sustained. The top of the hearth 1 is connected to a separator member 2 via an extraction duct 12 which conveys the flue gases and the recycled particles.

The separator member 2, e.g. a cyclone, delivers the gas to a flue duct 20 leading off from its top, and it delivers the particles to a recycling duct 23 which leads into an external dense fluidized bed 3. The recycling duct is generally provided with a siphon and with lagging. The external bed is provided with a first heat exchanger 3A which, in this example, is in the form of a nest of tubes that zigzag in vertical planes, so that the long tube segments are preferably horizontal. The first heat exchanger 3A is fed with a coolant fluid to be evaporated, e.g. water, via an inlet duct 39. The outlet 30 of the heat exchanger 3A is connected to a second heat exchanger 3B which is in contact with the hearth 1.

Figure 2:
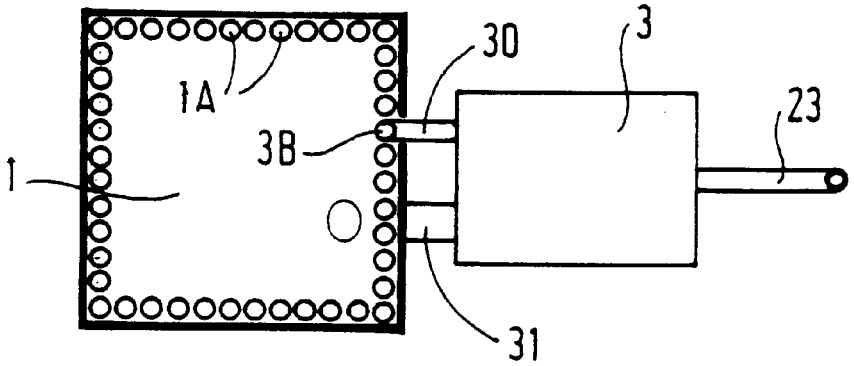
FIG. 2 is a horizontal section view of a first embodiment.

A first embodiment of the second heat exchanger 3B shown in FIGS. 1 and 2 is applicable when the wall of the upper body of the hearth is implemented in the form of a set of vertical pipes 1A that are secured together. In which case, one of the pipes constitutes the second heat exchanger 3B connected at its bottom end to the outlet 30 of the first heat exchanger 3A. It should be noted that, in this example, the first heat exchanger 3A is provided with one outlet only. Naturally, if the first heat exchanger is in the form of a nest of tubes, as many pipes 1A can be provided in the second heat exchanger 3B as there are tubes in the nest.

Figure 3:
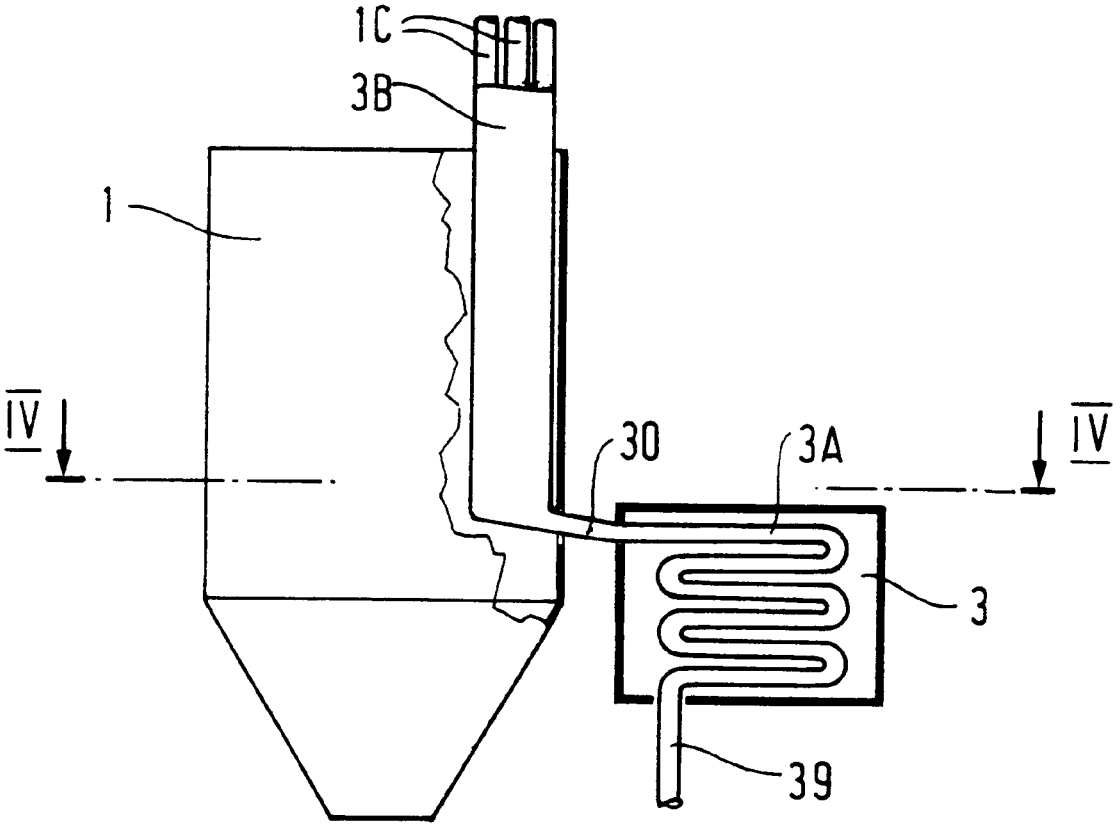
FIG. 3 is a vertical section view of a second embodiment.
Figure 4:
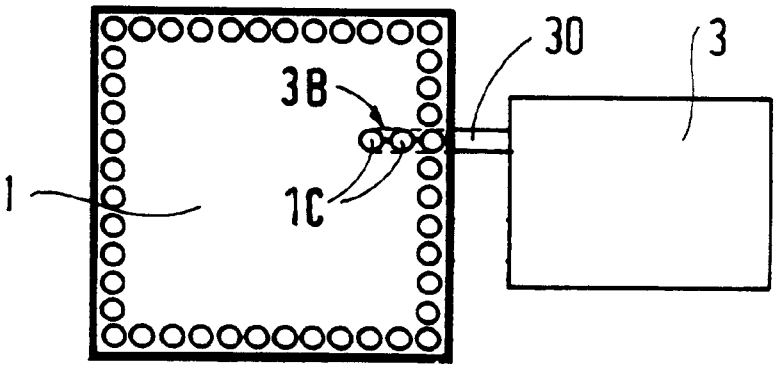
FIG. 4 is a horizontal section view of a third embodiment.

In a second embodiment shown in FIG. 3, regardless of the type of wall used for the hearth, the second heat exchanger 3B is an evaporator disposed inside said hearth.

The invention is applicable to a boiler whose hearth 1 made up of pipes is provided with a circulating fluidized bed. It is then common to provide at least one screen extension welded to the inside of the wall of the hearth. The screen extension is itself made up of vertical pipes that are secured together.

Thus, in a third embodiment, the second heat exchanger 3B is constituted by one of the pipes of the screen extension, which pipe is connected at its bottom end to the outlet 30 of the first heat exchanger 3A.

Figure 5:
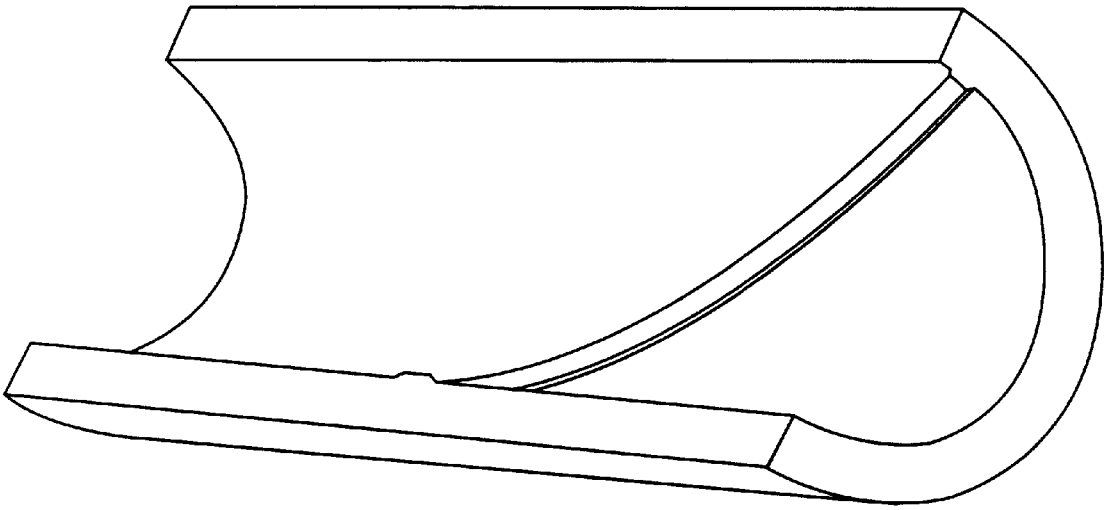
FIG. 5 is a view showing a helical groove along the inside of one of the tubes in a heat exchanger.

In addition, the performance of the first heat exchanger 3A is further improved when the tubes making it up are rifled tubes, i.e. their inside surfaces are provided with one or more helical grooves. See FIG. 5, for example. As a result of the centrifugal force, the vapor phase of the emulsion concentrates towards the insides of the tubes, thereby preventing DNB.

Naturally, the invention is intended for a natural-circulation first heat exchanger. However, if an assisted-circulation heat exchanger is provided, the invention makes it possible to reduce very significantly the power required by the assistance pump(s), and thus to reduce cost and electricity consumption accordingly.

The above-described embodiments are given by way of example, and a person skilled in the art can understand that the invention may be implemented in many different ways, e.g. by replacing any means with any equivalent means.

We claim:

1. A boiler comprising a circulating fluidized bed hearth, a separator member for separating flue gas and solids extracted from the hearth, an external dense fluidized bed between the solids outlet of said separator member and the base of said hearth, the external bed containing a first heat exchanger in which a coolant fluid to be evaporated circulates, wherein the outlet of the first heat exchanger is connected to a second heat exchanger placed in the hearth.

2. A boiler according to claim 1, wherein said first heat exchanger operates by natural circulation.

3. A boiler according to claim 1, wherein said first heat exchanger is made up of a nest of tubes.

4. A boiler according to claim 3, wherein said tubes are horizontal.

5. A boiler according to claim 3, wherein each of said tubes is provided with at least one helical groove.

6. A boiler according to claim 1, wherein said second heat exchanger is an integral part of a wall of said hearth.

7. A boiler according to claim 1, wherein said second heat exchanger is immersed in said hearth.

8. A boiler according to claim 1, wherein said second heat exchanger is disposed in a screen extension connected to a wall of said circulating fluidized bed hearth.

* * * * *